US006144134A

United States Patent [19]

Lin

[11] Patent Number: 6,144,134

[45] Date of Patent: Nov. 7, 2000

[54] STRUCTURE HIDDEN MOUNT FOR ELECTRIC MOTOR CARBON BRUSHES

[76] Inventor: Shoei-Cherng Lin, No. 402, Sec.1, Min-Tzwu Road, Tarn-Tzyy, Hsiang, Tai-Chung Hsien, Taiwan

[21] Appl. No.: 09/419,287

[22] Filed: Oct. 15, 1999

[51] Int. Cl.[7] ..... H01R 39/38

[52] U.S. Cl. ..... 310/239; 310/238; 310/71; 310/242; 310/249; 310/251

[58] Field of Search ..... 310/238, 239, 310/242, 249, 251, 71; 29/596

[56] References Cited

U.S. PATENT DOCUMENTS 4,851,730 7/1989 Fushiya et al. ..... 310/249
4,868,441 9/1989 Bulick ..... 310/239
4,990,811 2/1991 Nakata et al. ..... 310/239
5,397,952 3/1995 Decker et al. ..... 310/242
5,648,695 7/1997 Yamaguchi et al. ..... 310/242

*Primary Examiner*—Nestor Ramirez
*Assistant Examiner*—Thanh Lam
*Attorney, Agent, or Firm*—Bacon & Thomas, PLLC

[57] ABSTRACT

A structure for mounting a brush on an electric motor, including a mounting bracket having an opening at one end for allowing the brush to slide out of the mounting bracket and abut a moving conductor, a slot formed in a side wall of the mounting bracket for passing a pigtail wire, a tab portion in the side wall extending across the slot near the opening of the mounting bracket, and wherein the tab portion forms a space between the side wall and the brush for accommodating the wire as the brush slides out of the mounting bracket.

5 Claims, 4 Drawing Sheets

STRUCTURE HIDDEN MOUNT FOR ELECTRIC MOTOR CARBON BRUSHES

BACKGROUND OF THE INVENTION

1. Field of the Invention

The invention herein relates to an improved structure hidden mount for electric motor carbon brushes comprised of one-piece fabricated conductive copper mounts conjoined to two sides of bakelite and, furthermore, having a curved retaining tab projecting from one side of the conductive copper mount near the terminal connector, a structural innovation that not only permits the easy placement of the carbon brushes, but also simplifies and accelerates the process of conjoining the conductive copper mounts to the bakelite; furthermore, since the conductive spade plug of the conductive copper mounts as well as the terminal connector of the external wiring are on the same side, the conductive copper mounts can be interchangeably installed to either of the two sides of the bakelite, thereby reducing production costs, with the advantages of this interchangeability also simplifying the assembly process and further lowering many aspects of production overhead.

2. Description of the Prior Art

Referring to FIG. 1, a conventional electric motor carbon brush mount is comprised of a bottom plate 1, bakelite 2 conjoined to the upper extent of the bottom plate 1, conductive copper mounts 6 fastened onto the bakelite 2, and carbon brushes 4 inserted into the conductive copper mounts 6; wherein each of the said conductive copper mounts 6 consists of an upper copper strip element 61 and an lower copper strip element 62 that are placed together and then fastened to the bakelite 2, and two lateral openings 612 of the brush containment slot 611 are formed along the center of the upper copper strip element 61, with a terminal connector 613 formed on one side and a conductive spade plug 614 formed on the other side; as such, after a carbon brush 4 is installed into each of the conductive copper mounts 6, the copper wires 41 of the carbon brushes 4 are routed through the openings 612 and then attached to the conductive spade plugs 614 of the conductive copper mounts 6, thereby achieving an electric motor carbon brush mount structure.

However, due to its structural characteristics, the said electric motor brush mount is incapable of achieving ideal performance in actual utilization, with the generally observed drawbacks including:

1. Non-interchangeable Components

Since the conventional carbon brush mounts are situated at the lateral end of the conductive copper mounts 6 and, furthermore, are in continuity with the conductive spade plug 614 of the carbon brushes 4 as well as the externally connected wires of the terminal connectors 613, and since each of the said parts are respectively formed on the two sides of the conductive copper mounts 6 which are respectively fastened to the two sides of the bakelite 2, they are structurally dissimilar and cannot be interchangeably utilized.

2. Difficult Assembly

When the conventional carbon brush mounts are assembled, the upper and lower copper strip elements 61 and 62 must first be placed together, after which the carbon brushes 4 are installed into them, and then fastened to the bakelite 2 and, furthermore, following fastening, the terminal connectors 613 must also be coupled, resulting in a relatively difficult assembly procedure; furthermore, the brush containment holes 611 of the said terminal connectors 613 providing for the installation of the carbon brushes 4 have straight surfaces along their two sides such that when the brushes 4 are inserted, the copper wires 41 of the sides become caught in the straight surfaces at the two sides of the brush containment holes 611 and cannot be inserted through; as such, it is difficult to install the carbon brushes 4 into the brush containment holes 611 of the conductive copper mounts 6 and, furthermore, fastening the conductive copper mounts 6 to the bakelite 2 is similarly arduous.

3. Increased Production Cost

Since the conventional conductive copper mounts 6 are fastened to the two sides of the bakelite 2 and consist of dissimilarly structured upper and lower copper strip elements 61 and 62 that must be placed together and then fastened to the bakelite 2, when they are fastened, since the alignment is difficult, this results in a high post-fastening defect rates; furthermore, since the copper mounts 6 consist of dissimilarly structured upper and lower copper strip elements 61 and 62, each copper strip element requires a separate fabrication mold, which not only increases production cost, but also raises the fastening defect rate, resulting in greater cost burdens for manufacturers.

In view of the said drawbaoks, the applicant of the invention herein, having accumulated many years of specialized experience in the electric motor accessories industry, conducting extensive research, which finally culminated in the development of the invention herein. Furthermore, following completion of the design, the product was fabricated, tested for feasibility, and found to be fully compliant with new patent application requirements, following which the improved structure hidden mount for electric motor carbon brushes of the present invention was submitted in application for patent rights.

SUMMARY OF THE INVENTION

The primary objective of the invention herein is to provide a standard component and, furthermore, interchangeably advantageous improved structure hidden mount for electric motor carbon brushes in which the said carbon brush mount is comprised of a bottom plate, bakelite conjoined to the upper extent of the bottom plate, a conductive copper mount fastened to each of the two ends of the bakelite, a carbon brush inserted into the interior section of each of the conductive copper mounts, and wires externally connected to a terminal connector on each of the conductive copper mounts; since the conductive spade plug of the conductive copper mounts as well as the terminal connector of the external wiring are on the same side, the conductive copper mounts can be interchangeably installed to either of the two sides of the bakelite because they are structurally identical, thereby achieving the interchangeable utilization of the conductive copper mounts.

Another objective of the invention herein is to provide an improved structure hidden mount for electric motor carbon brushes in which a curved retaining tab projects from one side of the conductive copper mount near the terminal connector and, furthermore, the terminal connector is of one-piece construction, a structural innovation that not only permits the easy placement of the carbon brushes in the brush containment holes of the conductive copper mounts, but also facilitates the fastening of the conductive copper mounts to the bakelite, thereby effectively simplifying and accelerating the assembly of the carbon brush mount.

Yet another objective of the invention herein is to provide an improved structure hidden mount for electric motor carbon brushes in which since the conductive copper mounts can be mounted on either of the two sides of the bakelite, they are structurally similar and interchangeable assembly-wise and, therefore, only one mold is required to fabricate the conductive copper mounts, thereby reducing the fabrication cost of the conductive copper mounts and effectively lowering the overall production overhead.

To enable the examination committee to further understand the structure, innovations, functions, and other objectives of the present invention, the brief description of the drawings below is followed by the detailed description of the invention herein.

DETAILED DESCRIPTION OF THE INVENTION

Figure 1:
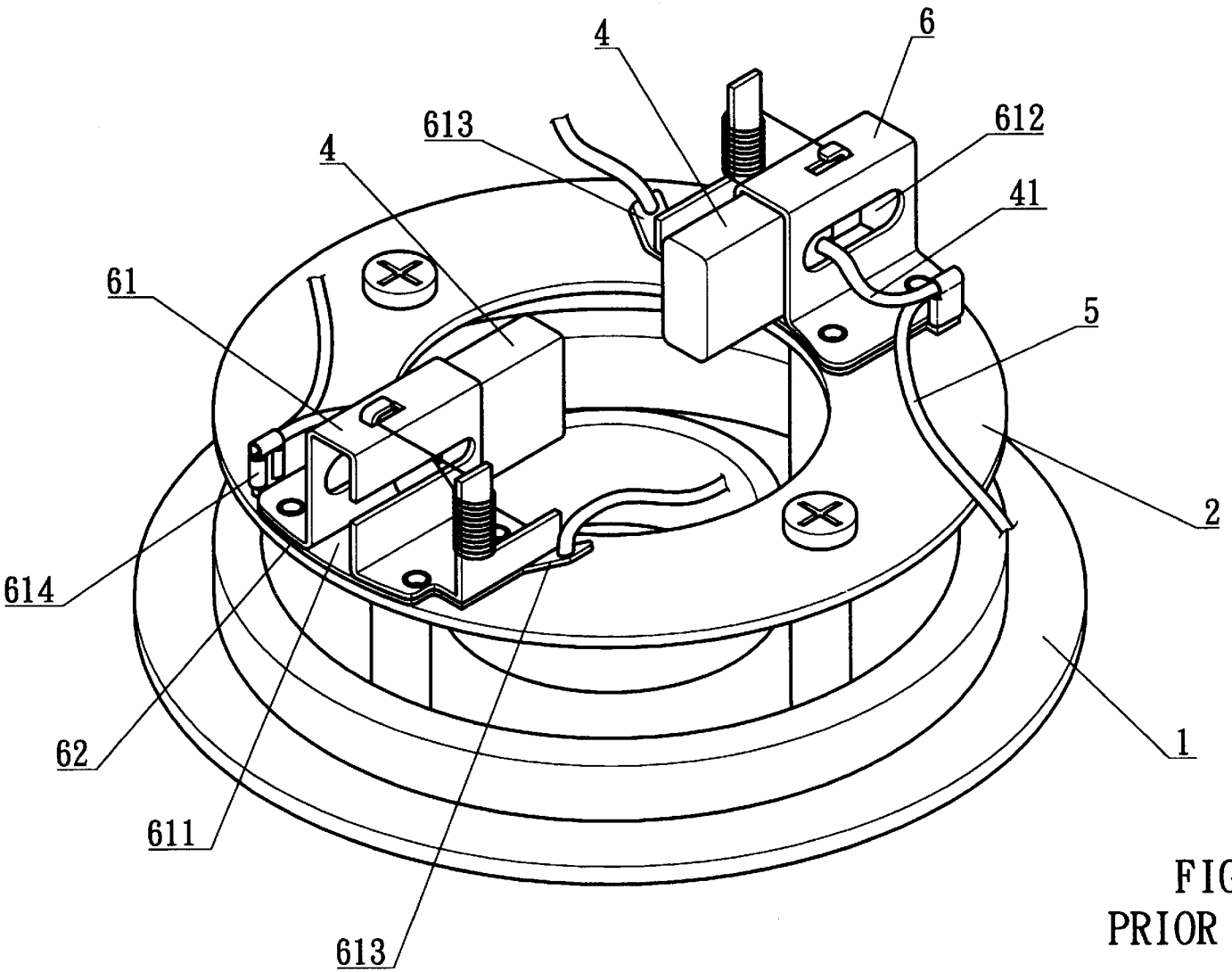
FIG1 PRIOR ART
FIG. 1 is an isometric drawing of a conventional electric motor carbon brush mount.
Figure 2:
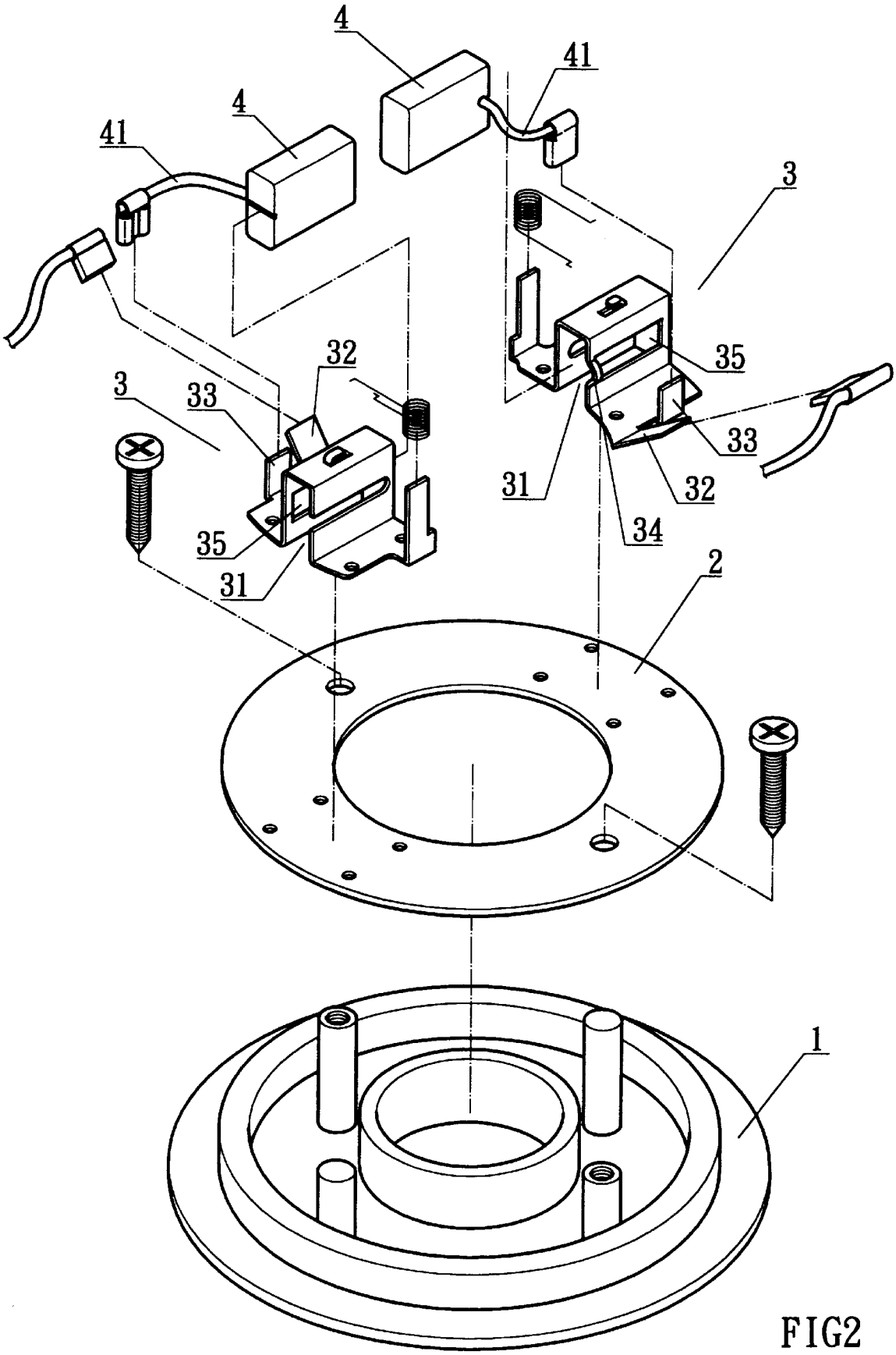
FIG. 2 is an exploded drawing of the electric motor carbon brush mount of the invention herein.
Figure 3:
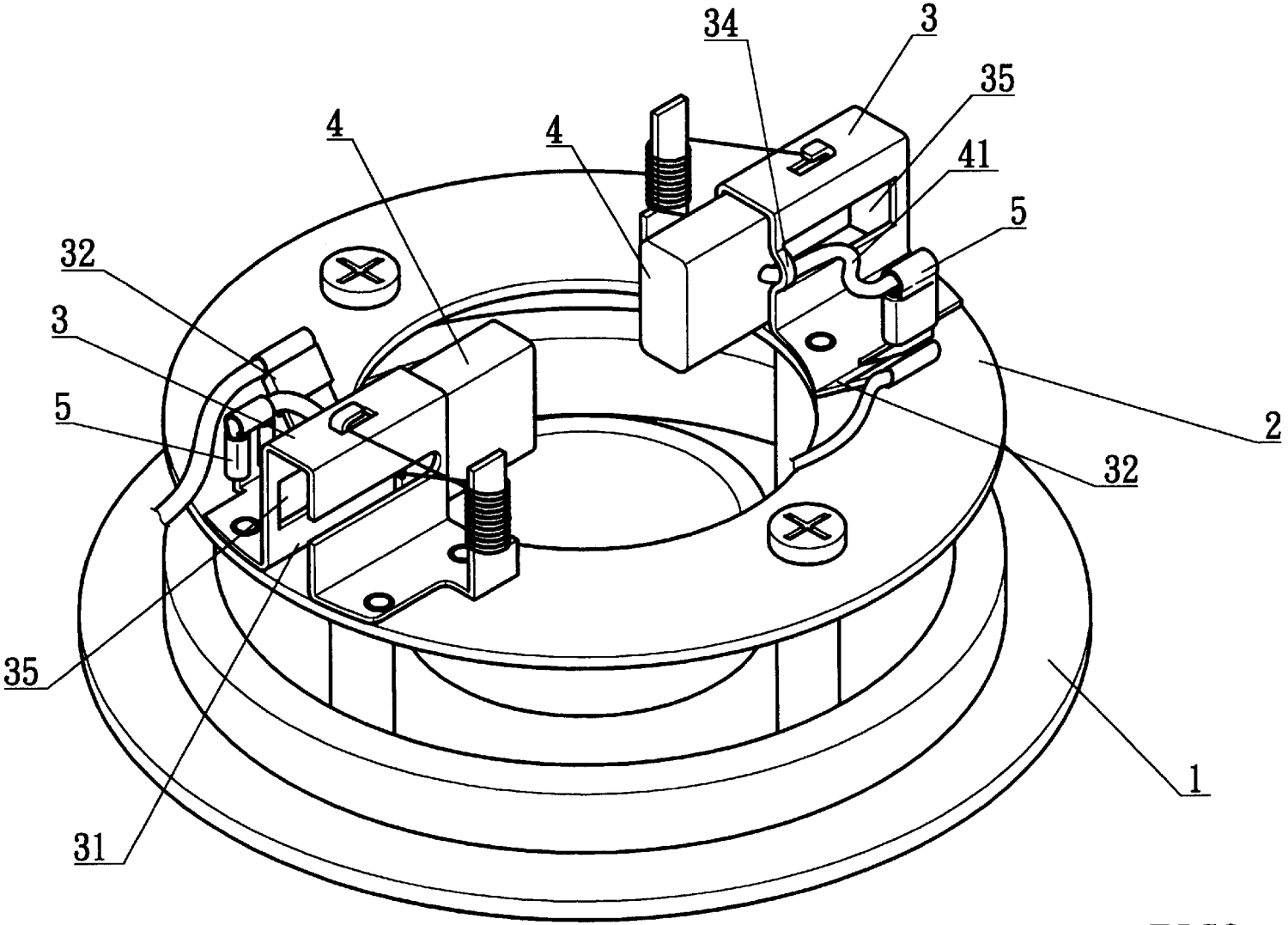
FIG. 3 is an isometric drawing of the electric motor carbon brush mount of the invention herein.

Referring to FIG. 2 and FIG. 3, the structure of the invention herein is comprised of a bottom plate 1, bakelite 2 conjoined to the upper extent of the bottom plate 1, a conductive copper mount 3 fastened to each of the two ends of the bakelite 2 and, furthermore, having an opening 35 along one side, a carbon brush 4 inserted into each of the conductive copper mounts 3, and wires 5 externally fastened to a terminal connector 32 on each of the conductive copper mounts 3, of which:

The said copper mounts 3 are punch fabricated from a single flat piece and, furthermore, have carbon brush containment holes 31 formed through the center, a terminal connector 32 with a conductive spade plug 33 at one side, and a projecting curved retaining tab 34 that provides for the insertion of the copper wire 41 of each carbon brush 4.

Each of the said carbon brushes 41 has a laterally attached copper wire 41 and, furthermore, the copper wire 41 fits through the curved retaining tab 34 projecting from the conductive copper mounts 3 such that when a carbon brush 4 is installed into the interior section of a conductive copper mount 3, the sides of the carbon brush containment holes 31 do not obstruct insertion, thereby facilitating the efficient placement of the carbon brush 4 into the conductive copper mount 3.

Figure 4:
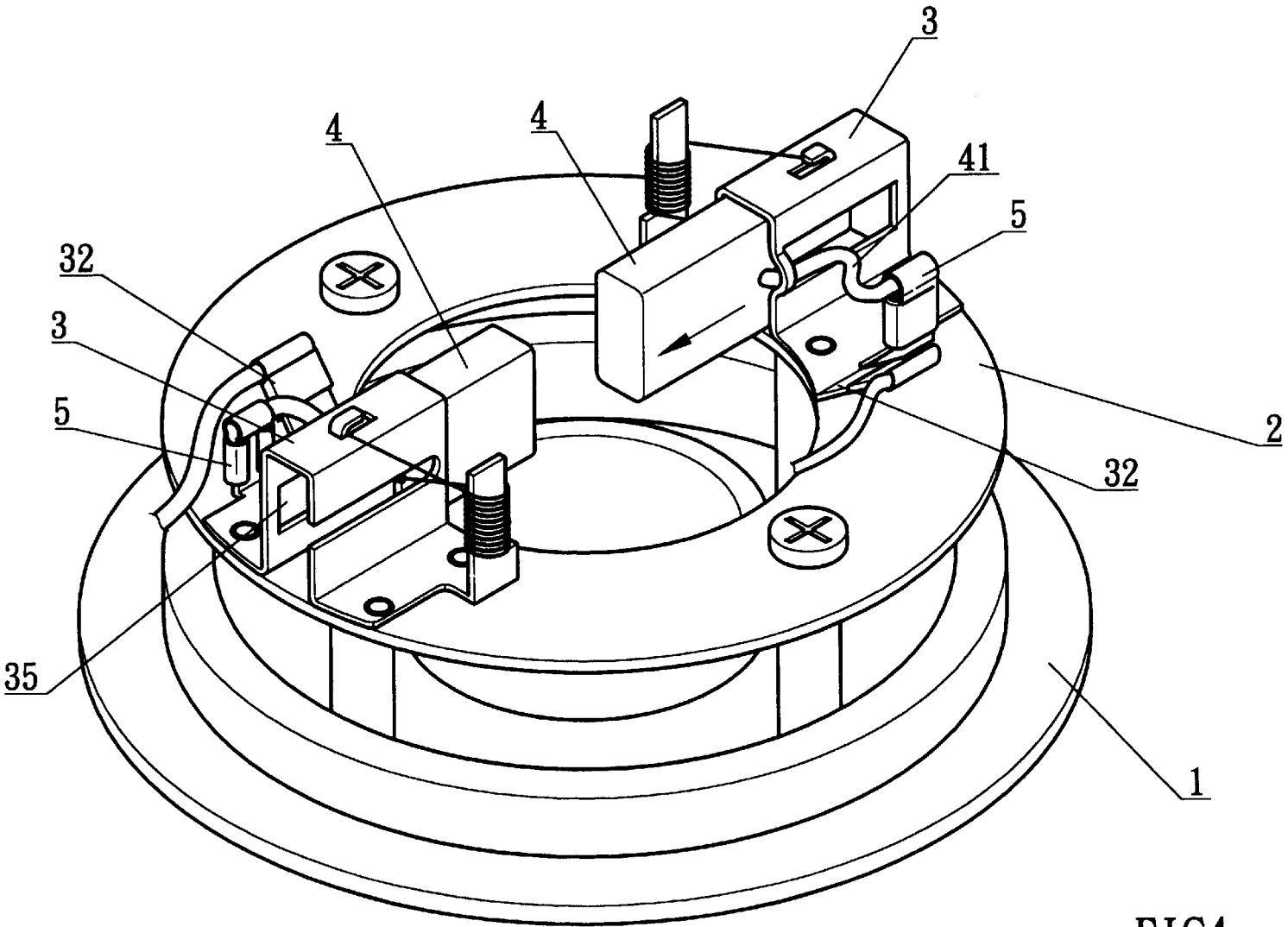
FIG. 4 is an isometric drawing of and embodiment of the electric motor carbon brush mount of the invention herein.

Referring to FIG. 4, since the conductive copper mounts 3 are one-piece fabricated structures having a terminal connector 32 formed at one side as well as a projecting curved retainer tab 34 for routing the carbon brush 4 wire 41, this innovative approach not only permits the easy placement of the carbon brushes 4 into the carbon brush containment holes 31 of the conductive copper mounts 3, but also simplifies and accelerates the process of conjoining the conductive copper mounts 3 to the bakelite 2; furthermore, due to the said lateral construction details of the conductive copper mounts 3 and, furthermore, the forming of the conductive spade plug 33 in continuity with the carbon brush 4 and the terminal connector 32 of the external wires 5 on the same side of the conductive copper mounts 3, the conductive copper mounts 3 can be interchangeably installed to either of the two sides of the bakelite 2, thereby reducing production costs, with the advantages of this interchangeability also simplifying the assembly process and further lowering many aspects of production overhead.

In summation of the foregoing section, since the improved structure hidden mount for electric motor carbon brushes of the invention herein and its innovative fabrication process are capable of achieving the claimed objectives of the present invention and, furthermore, is of greater practical value than the conventional products, the invention herein is lawfully submitted in application for and the granting of the commensurate patent rights in accordance with the Patent Law encouraging the spirit of invention.

What is claimed is:

1. An improved structure for mounting carbon brushes including a bottom plate, bakelite conjoined to the upper extent of the bottom plate, a conductive copper mount fastened to each of the two ends of the bakelite, a carbon brush inserted into a containment hole formed in each of the conductive copper mounts, and wires externally fastened to a carbon brush and a terminal connector on each of the conductive copper mounts, wherein the improvement comprises:

said conductive copper mounts are punched fabricated with said terminal connectors having a conductive spade plug formed on one side thereof;

an outwardly curved retaining tab formed near said terminal connector the side of the carbon brush containment hole of the said conductive copper mount for routing the wires that are fastened to the carbon brushes, thereby achieving easy placement into the carbon brush containment hole and simplifying and accelerating the process of conjoining the conductive copper mounts to the said bakelite;

whereby the conductive copper mounts can be interchangeably installed to either of the two sides of the said bakelite, thereby lowering many aspects of production overhead; and wherein said tab portion is connected to top and bottom walls of said mounting bracket.

2. A structure for mounting a brush on an electric motor comprising:

a mounting bracket having an opening at one end for allowing the brush to slide out of the mounting bracket and abut a moving conductor;

a slot formed in a first side wall of the mounting bracket for passing a pigtail wire having one end connected to the brush;

said first side wall of the mounting bracket including a tab portion that extends across the slot near the opening at one end of the mounting bracket;

wherein said tab portion forms a space between the first side wall of the mounting bracket and the brush for accommodating the pigtail wire as the brush slides out of the mounting bracket; and wherein said tab portion is connected to too and bottom walls of said mounting bracket.

3. The structure recited in claim 1 wherein said tab portion of the wall includes an outwardly curved strip.

4. The structure recited in claim 3, wherein said mounting bracket further includes a second side wall having another slot formed therein for passing an end of a spring that urges said brush out of the mounting bracket.

5. The structure recited in claim 4, wherein said spring is a helical spring supported by a post on the mounting bracket.

* * * * *